US007007342B2

(12) United States Patent
Huang

(10) Patent No.: US 7,007,342 B2
(45) Date of Patent: Mar. 7, 2006

(54) DOOR CLOSER

(76) Inventor: Tan-Cheng Huang, 6 Fl., No.2-1, Swei St., Taichung (TW)

( * ) Notice: Subject to any disclaimer, the term of this patent is extended or adjusted under 35 U.S.C. 154(b) by 17 days.

(21) Appl. No.: 10/843,541

(22) Filed: May 10, 2004

(65) Prior Publication Data

US 2005/0246860 A1 Nov. 10, 2005

(51) Int. Cl.
*E05F 1/08* (2006.01)

(52) U.S. Cl. ..... 16/79; 16/52; 16/62; 16/64

(58) Field of Classification Search ..... 16/79, 16/49, 62, 52, 71, 64, 51, 72, 66, 58
See application file for complete search history.

(56) References Cited

U.S. PATENT DOCUMENTS

| | | | | | |
|---|---|---|---|---|---|
| 1,723,445 | A | * | 8/1929 | Schmitt | 267/224 |
| 2,948,915 | A | * | 8/1960 | Vose | 16/82 |
| 3,491,993 | A | * | 1/1970 | Pedersen et al. | 267/126 |
| 4,097,956 | A | * | 7/1978 | Kitutaka | 16/52 |
| 4,115,897 | A | * | 9/1978 | Zunkel | 16/49 |
| 5,259,090 | A | * | 11/1993 | Fayngersh | 16/52 |
| 5,265,306 | A | * | 11/1993 | Yu | 16/51 |
| 5,586,361 | A | * | 12/1996 | T olle et al. | 16/51 |
| 5,802,670 | A | * | 9/1998 | Bienek | 16/53 |
| 6,151,753 | A | * | 11/2000 | Salutzki | 16/62 |
| 2002/0010977 | A1 | * | 1/2002 | Salice | 16/49 |

FOREIGN PATENT DOCUMENTS

| | | | |
|---|---|---|---|
| DE | 3320609 | A1 * | 12/1984 |
| DE | 3411189 | A1 * | 10/1985 |
| DE | 4101640 | A1 * | 7/1992 |
| GB | 2116251 | A * | 9/1983 |
| GB | 2268540 | A * | 1/1994 |

* cited by examiner

*Primary Examiner*—Chuck Y. Mah
*Assistant Examiner*—Mark T. Vogelbacker
(74) *Attorney, Agent, or Firm*—Charles E. Baxley

(57) ABSTRACT

The present invention relates to a door closer, in a housing of which is received a sliding cylinder, the sliding cylinder is provided with teeth on an outer periphery thereof for meshing with a gear wheel of a door shaft, a sliding cylinder interiorly formed with inner wall serves to move relative to a piston of a piston shaft. At an end of the piston shaft is provided with an oil-replenishing cylinder that serves to replenish hydraulic oil to the sliding cylinder via a one-way valve.

8 Claims, 20 Drawing Sheets

DOOR CLOSER

FIELD OF THE INVENTION

The present invention relates to a door closer, and more particularly to an auxiliary buffering structure which is used on doors and/or windows.

DESCRIPTION OF THE PRIOR ARTS

The conventional door closers sold in market usually have a cylinder filled with hydraulic oil that is used as an operating space for other components. The hydraulic (pneumatic) door closer is disposed between the door and a wall to provide buffering effect at the end of a door opening or closing action. This kind of hydraulic (pneumatic) door closer has been commonly applied to all kinds of doors and windows, however, there are still some disadvantages will be resulted from real operation as follows:

First, the cylinder of the conventional door closer is filled with hydraulic oil and formed by aluminous die-casting. To avoid oil leak caused by gas cavities, the producer has to filter the aluminous liquid for several times during the die-casting process and should form the cylinder by vacuum die-casting. Furthermore, the door closer should be inspected during and after the die casting process. Thereby, the production cost of this door closer is pretty high. Moreover, the problem of gas cavity is difficult to be eliminated completely, so the door closer of this kind is susceptible to oil-leak.

Second, the hydraulic oil used in the conventional door closer must be easy to flow, so the tolerance of fit between the piston and the oil cylinder must be very small, so as to prevent the hydraulic oil leaking from the clearance between the piston and the oil cylinder and result in a bad buffering effect. Since the cylinder and piston are made by aluminous die-casting, after a certain period of usage, the cylinder and the piston will be worn and lead to a not good buffering effect.

Third, a conventional door closer is not provided with oil-replenishing cylinder and the hydraulic oil occupies the whole housing of the door closer, and the oil is easily evaporated, thereby, the buffering effect of the door closer will be weakened after a certain time of usage.

Fourth, the hydraulic oil occupies the whole housing of the door closer, so the volume of the hydraulic oil is relatively great. Moreover, the hydraulic oil is flammable and the door closer is often disposed on the entrance-exit door, so it is also a security problem.

The present invention has arisen to mitigate and/or obviate the afore-described disadvantages of the conventional door closer.

SUMMARY OF THE INVENTION

In accordance with one respect of the present invention, there is provided a door closer, in a housing of which is received a sliding cylinder, the sliding cylinder is provided with teeth on an outer periphery thereof for meshing with a gear wheel of a door shaft. At an end of the piston shaft is provided with an oil-replenishing cylinder that serves to replenish hydraulic oil to the sliding cylinder via a one-way valve.

The primary object of the present invention is to seal the hydraulic oil in the inner wall of the sliding cylinder and the oil-replenishing cylinder, so the housing of the door closer is not filled with hydraulic oil. Moreover, only the side of the sliding cylinder and oil-replenishing cylinder is provided with sealing device. In this case, the present invention is able to reduce the hydraulic oil volume and improve the air-tightness of the door closer.

Another object of the present invention is to provide a door closer that has longer service life. The sliding cylinder is interiorly formed with inner wall, the oil replenishing cylinder and piston shaft. Since the sliding cylinder is formed with teeth on the outer surface thereof for driving purpose, the siding cylinder must be made of high-strength and high density steel material. In this case, the fit tolerance of hole and shaft is very small when the wall of the sliding cylinder is moving relative to the piston of the piston shaft, and the oil-leak problem is avoided. In addition, when the hydraulic oil in the sliding cylinder is reduced because of evaporation, the oil-replenishing cylinder will replenish hydraulic oil to the sliding cylinder via a one-way valve. Thereby, the lifetime of the working part of the door closer in accordance with the present invention for producing buffering effect is effectively prolonged.

The further object of the present invention is to effectively reduce the cost of the door closer. Since the hydraulic oil is sealed in the sliding cylinder and the oil-replenishing cylinder, the housing of the door closer can be produced based on the conventional casting process, and it doesn't need to inspect and reject the housing having gas cavities. Through this way, the material and production cost of the door closer can be substantially reduced.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
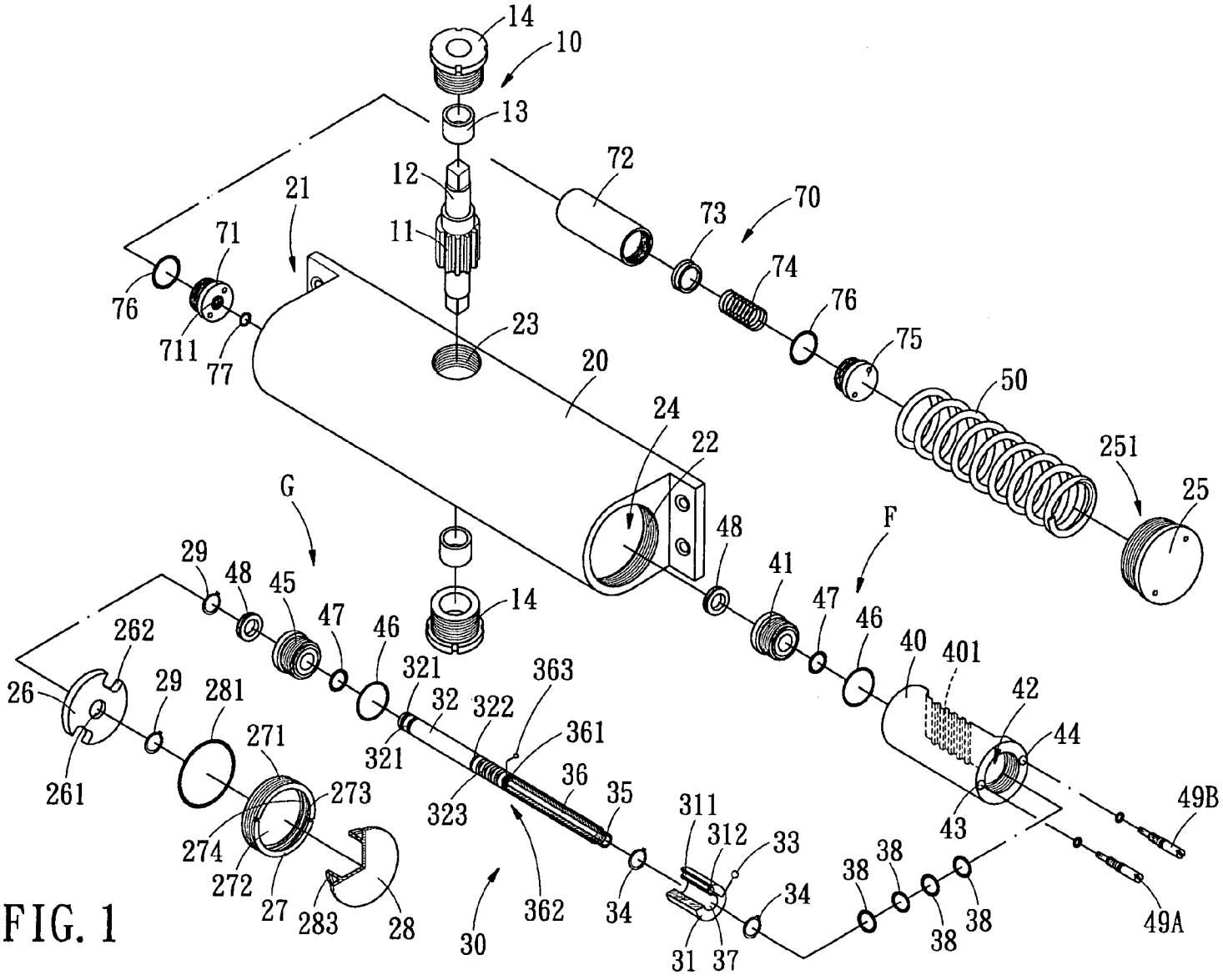
FIG. 1 is an exploded view of a door closer in accordance with a first embodiment of the present invention.
Figure 2:
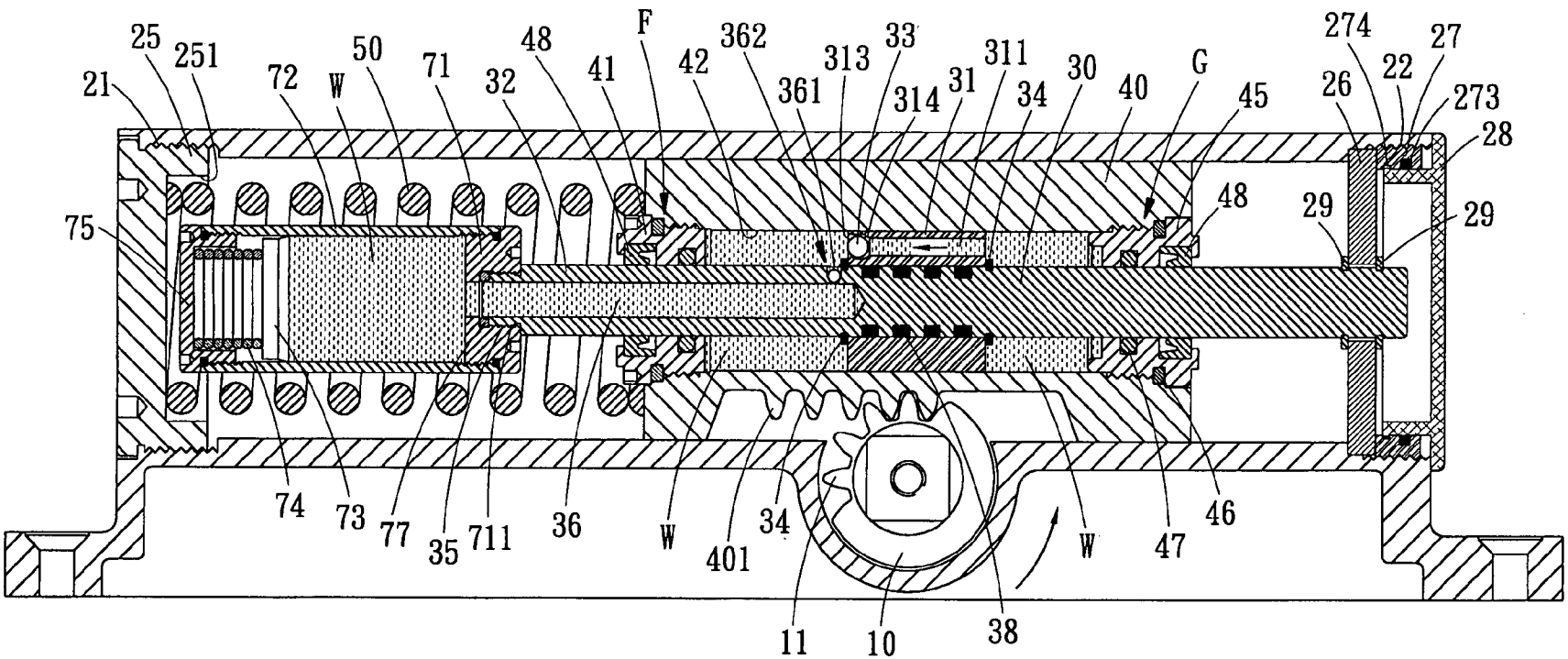
FIG. 2 is a cross sectional view of a door closer in an open state in accordance with a first embodiment of the present invention.
Figure 3:
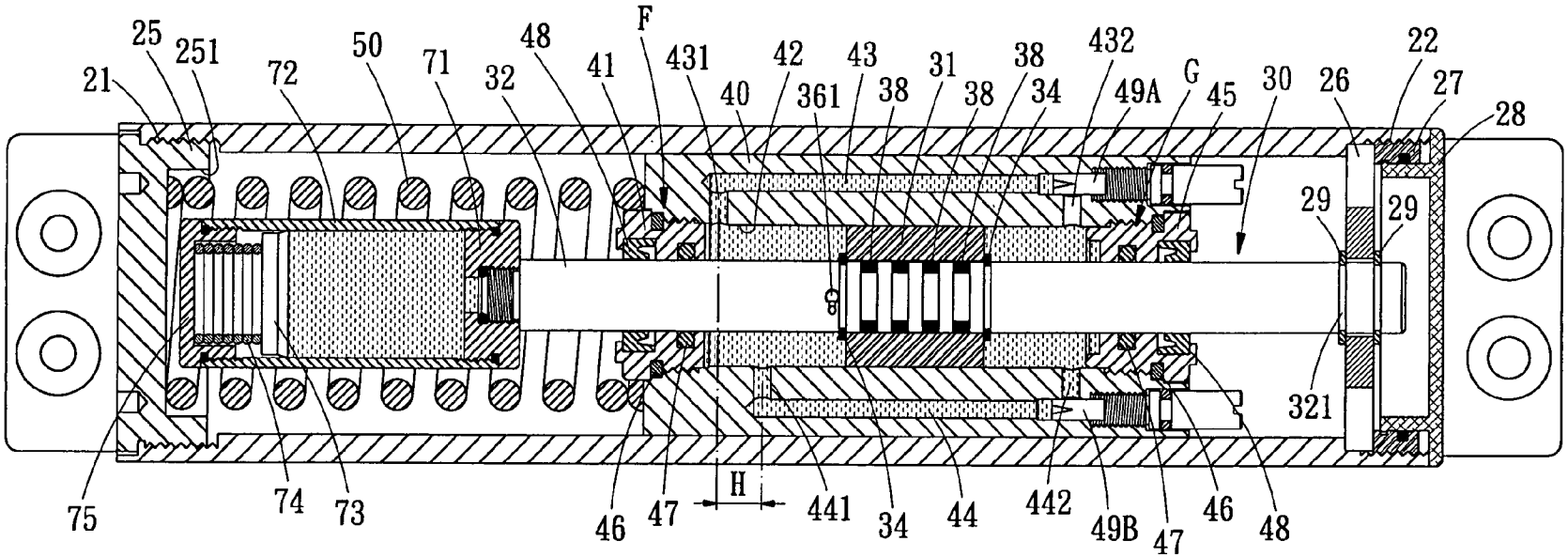
FIG. 3 is another cross sectional view of a door closer in an open state in accordance with a first embodiment of the present invention.

Referring to FIGS. 1–3, a door closer structure in accordance with a first preferred embodiment of the present invention generally comprises (since there are too many reference numbers in the embodiments, please refer together with the reference numbers in FIGS. 4–10) a door shaft 10, a housing 20, a piston shaft 30, a sliding cylinder 40, a door-closing spring 50 and an oil replenishing cylinder 70.

The door shaft 10 includes a shaft 12, two bearings 13 and a fixing cap 14. The shaft 12 revolves along with the opening and closing action of the door, and on the shaft 12 is defined with a gear wheel 11.

The housing 20 is interiorly defined with a hollow hydraulic space 24, and at both ends of housing 20 are respectively provided with first inner threads 21 and second inner threads 22. In the middle of the housing 20 a hole 23 is defined for the reception of the door shaft 10, and the gear wheel 11 of the door shaft 10 is accommodated in the hydraulic space 24 of the housing 20.

A spring cover 25 is screwed in the first inner threads 21, and the spring cover 25 is interiorly formed with a recess 251.

The second inner threads 22 are screwed with a positioning member 26 by cooperating with a fixing ring 27. The fixing ring 27 is formed with threads 271 on the outer surface thereof which are used to mesh with the second inner threads 22 of the base body 20. A through hole 272 is formed in the fixing ring 27, and a first annular dent 273 and a second annular dent 274 are respectively defined in the hole 272. In the first annular dent 273 is received a dust ring 281, and a dust cover 28 cooperates with the dust ring 281 and inserts in the hole 272 in a manner that a protrusive edge 283 of the dust cover 28 engages the second annular dent 274 of the fixing ring 27. The positioning member 26 is defined at a center thereof with a through aperture 261 for the insertion of a rod 32 of the piston shaft 30, furthermore, the positioning member 26 is formed with adjusting gaps 262 which allow the insertion of flow-adjusting screws 49A and 49B when the door is closed, such that the user can adjust the rotation of the door by opening the dust cover 28 (concerning the position of the flow-adjusting screws 49A and 49B, please refer to the introduction of the sliding cylinder 40).

The piston shaft 30 includes a piston 31 and a shaft 32.

Two annular grooves 321 are defined at a first end of the shaft 32 and used to engage the positioning member 26 of the housing 20 of the door closer by cooperating with C-shaped ring 29, while a second end of the shaft 32 is defined with threaded portion 35 which serves to engage the threaded hole 711 of the oil replenishing cylinder 70. The shaft 32 is interiorly defined with a passage 36 at a portion thereof opposite to the threaded portion 35, an outlet 361 is formed on the shaft 32, in which is received a one-way valve 362 (the one-way valve 362 is confined in the outlet 361 by punching). Furthermore, the shaft 32 is respectively defined at a middle portion thereof with two engaging grooves 322 and plural annular grooves 323.

The piston 31 is interiorly provided with a one-way valve and a through central hole 37. The central hole 37 is provided for insertion of the shaft 32, and two C-shaped rings 34 and plural O-shaped rings 38 are used to position the piston 31, such that the shaft 32 protrudes out of both ends of the piston 31. The O-shaped rings 38 are retained in the annular grooves 323 while the C-shaped rings 34 are received in the engaging grooves 322. The one-way valve of the piston 31 includes a guiding passage 311, an operating hydraulic space 312 and a steel ball 33. The guiding passage 311 is formed on the piston 31 starting from an end surface to the opposite end surface thereof, and the operating hydraulic space 312 is located in the guiding passage 311. The operating hydraulic space 312 and the guiding passage 311 are respectively provided with an open mouth 313 and a close mouth 314. The steel ball 33 is movably disposed in the operating hydraulic space 312. The close mouth 314 is configured to closely receive the steel ball 33 in a hermetic manner, while the open mouth 313 is unable to closely receive the steel ball 33.

The oil-replenishing cylinder 70 includes a cap 71, a cylinder 72, an oil-pressure piece 73, a spring 74, a spring cover 75 and plural oil seals 76. The cap 71 and the spring cover 75 serve to seal the oil-pressure piece 73 and the spring 74 in the cylinder 72 by cooperating with the plural oil seals 76. A side of the oil-pressure piece 73 facing the spring cover 75 is pushed by the spring 74, the hydraulic space of the oil-pressure piece 73 facing the cap 71 is filled with hydraulic oil W. The threaded hole 711 of the cap 71 engages the threaded portion 35 of the shaft 32 by cooperating with an oil seal 77, and the spring 74 serves to push the oil-pressure piece 73. The oil-pressure piece 73 pushes the hydraulic oil W from the inside of the cylinder 72 to the passage 36 of the shaft 32.

The sliding cylinder 40 is disposed in the hollow hydraulic space 24 of the housing 20 of the door closer, an inner wall 42 is defined in the sliding cylinder 40, which allows the piston 31 of the piston shaft 30 to slide against the inner wall 42 in a hermetic manner. The cylinder 40 is defined at the inner surface thereof with a second flow passage 43 and a first flow passage 44 for the insertion of the flow-adjusting screws 49A and 49B. And the rest of components of the sliding cylinder 40 are disposed at both sides thereof. On a portion of the sliding cylinder 40 corresponding to the gear wheel 11 of the door shaft 10 is formed with teeth 40, and the teeth 401 serve to mesh with the gear wheel 11. The front end of the flow-adjusting screws 49A and 49B correspond to the adjusting gaps 262 of the positioning member 26.

A first end of the sliding cylinder 40 corresponding to the flow-adjusting screws 49A and 49B is slidably provided with leak-proof assembly G, which includes a sliding bush 45, an outer seal ring 46, an inner seal ring 47 and an oil-sealing member 48. An outer periphery of the sliding bush 45 is sealed with the outer seal ring 46, while the inner periphery of the sliding bush 45 is slidably disposed on the shaft 32 of the piston shaft 30 by cooperating with the oil-sealing member 48 and the inner seal ring 47. A hydraulic space between the first end surface of the piston 31 and the leak-proof assembly G is filled with the hydraulic oil W.

A second end of the sliding cylinder 40 is slidably provided with a leak-proof assembly F, which including a sliding bush 41, an outer seal ring 46, an inner seal ring 47 and an oil-sealing member 48. An outer periphery of the sliding bush 45 is sealed with the outer seal ring 46, while the inner periphery of the sliding bush 45 is slidably mounted on the shaft 32 of the piston shaft 30 by cooperating with the oil-sealing member 48 and the inner seal ring 47. A hydraulic space between the second end surface of the piston 31 and the leak-proof assembly F is filled with the hydraulic oil W. In addition, a first and a second outlets 441, 431 of the first and the second flow passages 44, 43 are located adjacent to the leak-proof assembly F of the sliding cylinder 40, while an interval H is formed between the first and the second outlets 441, 431 of the first and the second flow passages 44, 43. A second and a first guiding mouth 432, 442 of the second and the first flow passage 43, 44 corresponding to the flow-adjusting screws 49A, 49B are connected to an end of the sliding bush 45 of the leak-proof assembly G.

The door-closing spring 50 serves to provide force for closing door, which is tensioned between the spring cover 25 of the housing 20 and the sliding cylinder 40 in a manner that a first end of the door-closing spring 50 is fixed in the recess 251 of the spring cover 25 and a second end of the door-closing spring 50 is positioned at the end of the sliding cylinder 40, and the door-closing spring 50 is located outside of the leak-proof assembly F.

Referring to FIGS. 2–10, which show the door closer in accordance with a first embodiment of the present invention, wherein:

As shown in FIGS. 2 and 3, when the user opens the door by force, the panel of the door drives the gear wheel 11 of the door shaft 10 to rotate counterclockwise, and the gear wheel 11 will move the sliding cylinder 40 toward the door-closing spring 50 by driving the teeth 401. In this case, the door-closing spring 50 is compressed by the cylinder 40. Since the piston shaft 30 is fixed to the positioning member 62 of the housing 20 by virtue of the two C-shaped rings 29, both the leak-proof assemblies F and G at both sides of the sliding cylinder 40 are slidably mounted on the shaft 32 of the piston shaft 30 in a hermetic manner by cooperating with the sliding bushes 41, 45, the outer seal rings 46, the inner seal rings 47 and the oil-sealing members 48, the hydraulic oil W will be compressed by the piston 31 and the sliding bush 45, such that the pressure of the hydraulic oil makes the hydraulic oil push the steel ball 33 to move toward the open mouth 313, thus the hydraulic oil W will flow from the hydraulic space (between the sliding bush 45 and the piston 31) to the hydraulic space between the sliding bush 41 and the piston 31 via the open mouth 313. And the hydraulic space between the sliding bush 41 and the piston 31 is re-filled with the hydraulic oil W. Therefore, the resistance force of hydraulic oil W is relative small, the user can open the door by a small force equal to the compressive force of the door-closing spring 50.

Figure 4:
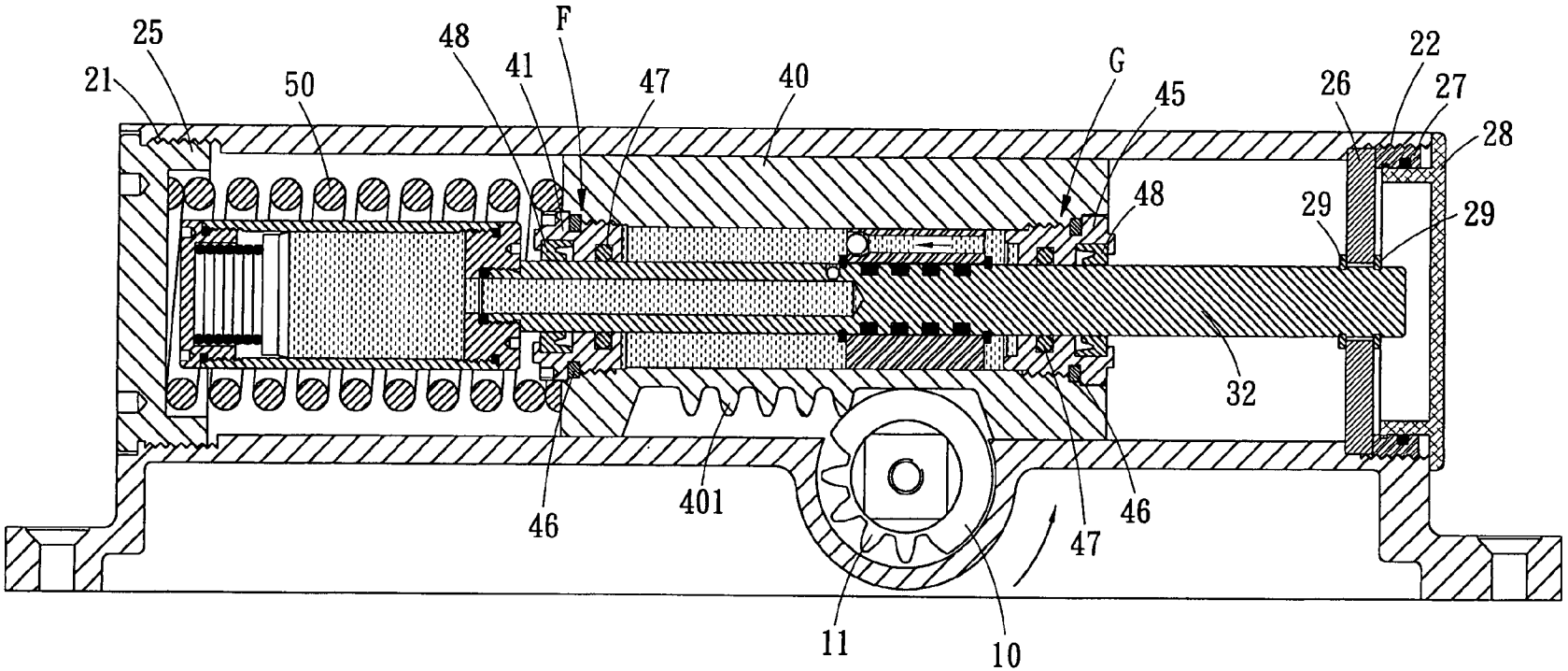
FIG. 4 is a cross sectional view of a door closer in a positioned state in accordance with a first embodiment of the present invention.
Figure 5:
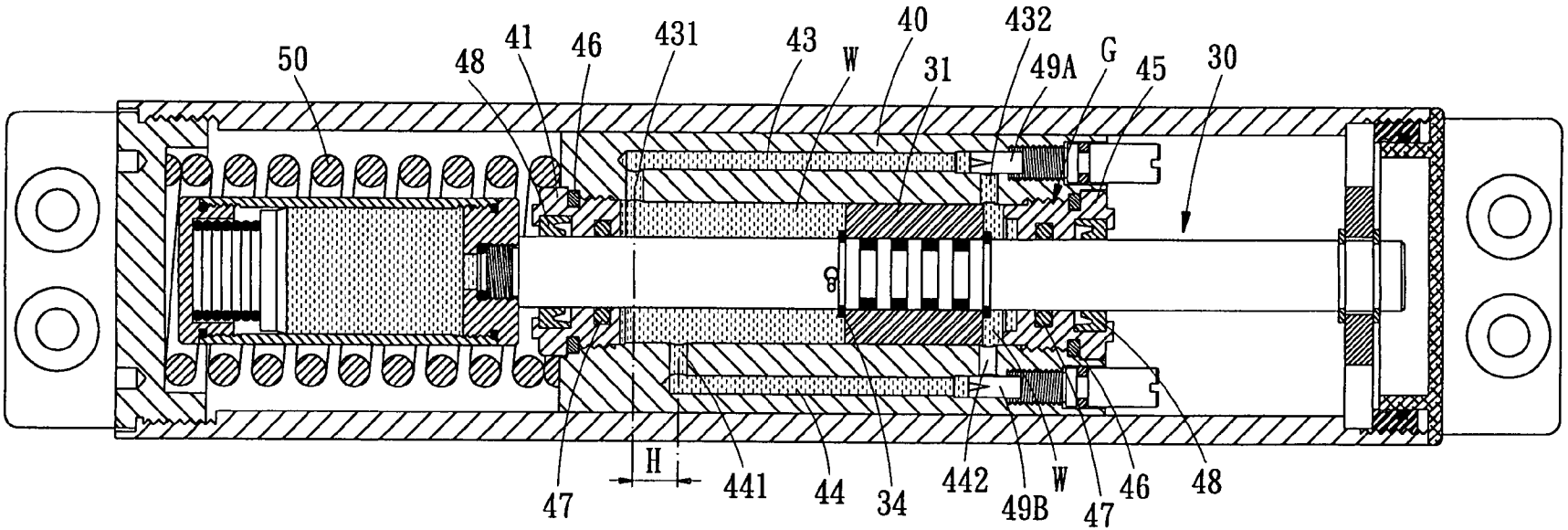
FIG. 5 is another cross sectional view of a door closer in a positioned state in accordance with a first embodiment of the present invention.

As shown in FIGS. 4 and 5, when the door is opened to a predetermined angle, the gear wheel 11 of the door shaft 10 will idly rotate relative to the teeth 401 of the sliding cylinder 40, at this moment, if the door is opened more wide, the gear wheel 11 of the door shaft 10 still idly rotates relative to the teeth 401, and it will not push the sliding cylinder 40 to move, and thus the door-closing spring 50 will not be compressed.

Figure 6:
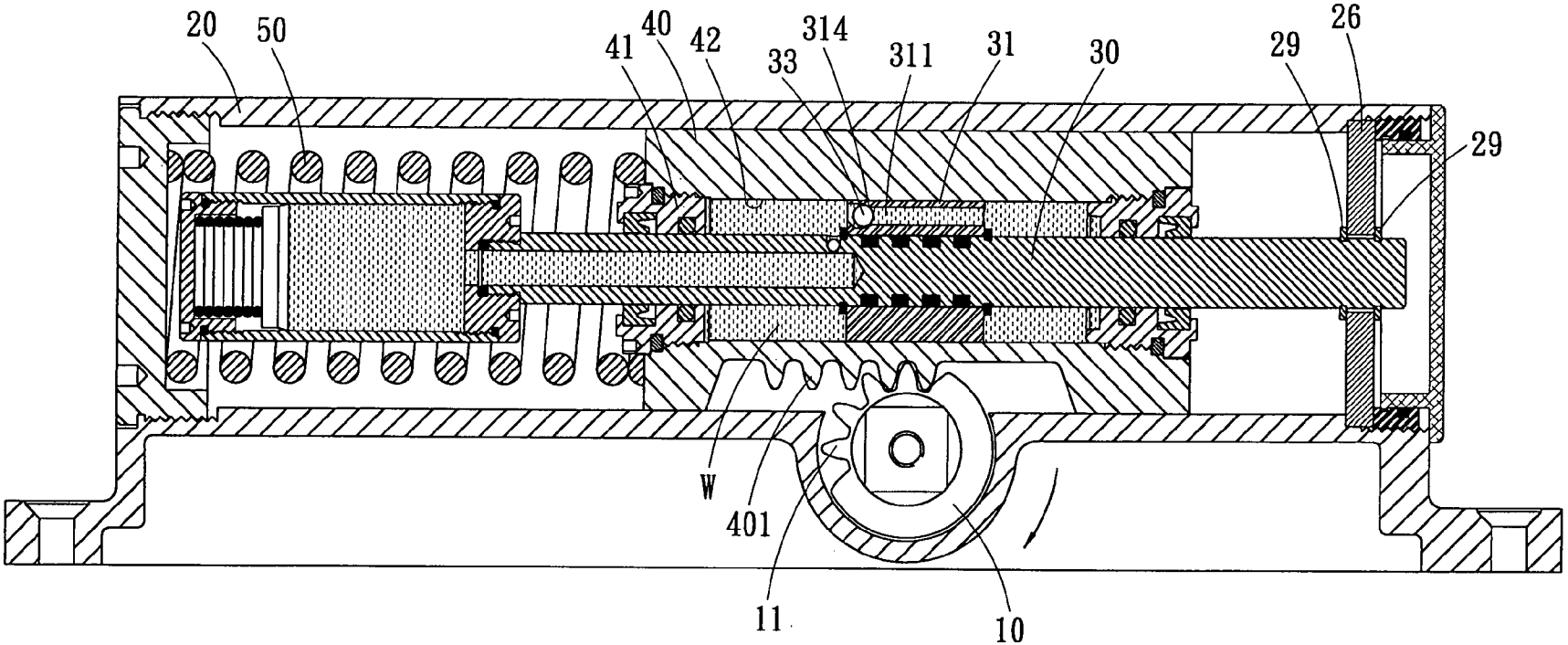
FIG. 6 is an operational view of a door closer in accordance with a first embodiment of the present invention, wherein the door is being closed.
Figure 7:
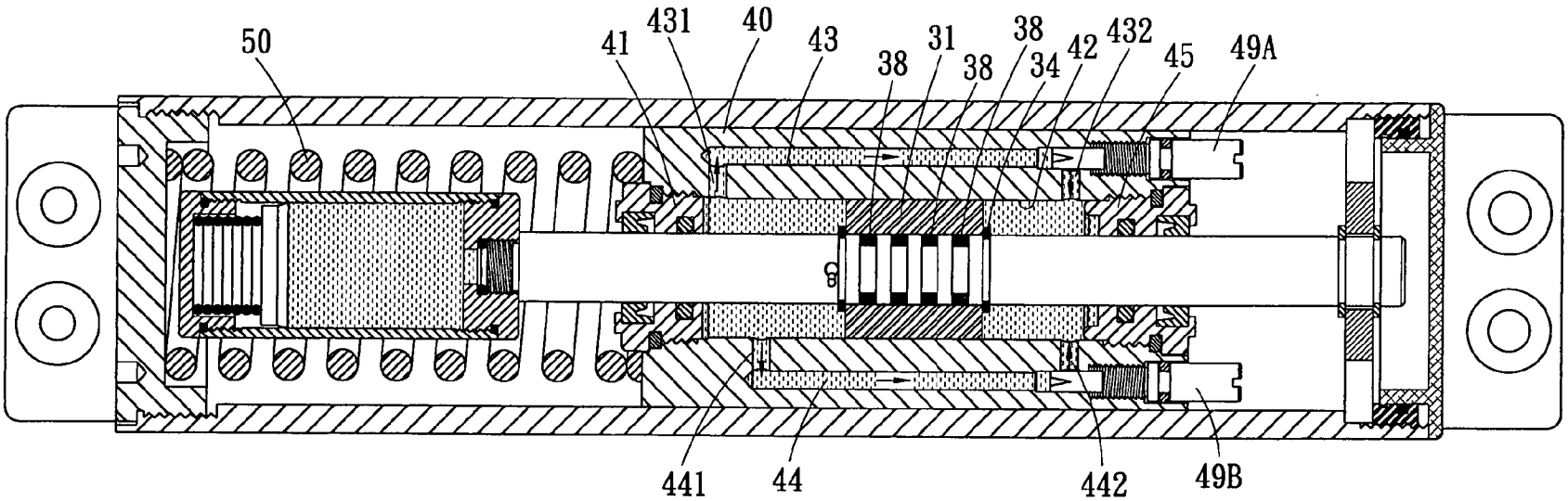
FIG. 7 is another operational view of a door closer in accordance with a first embodiment of the present invention, wherein the door is being closed.

As shown in FIGS. 6 and 7, when the user closes the door, the door-closing spring 50 expands to push the sliding cylinder 40 to move toward the positioning member 26 of the housing 20, and the gear wheel 11 of the door shaft 10 is driven by the teeth 401 of the sliding cylinder 40 to rotate clockwise, and the panel of the door is driven to rotate, thus the door is closed. At this moment, the sliding bush 41 at a side of the inner wall 42 of the sliding cylinder 40 slides toward the piston shaft 30 (the piston shaft 30 is fixed to positioning member 26 of the housing by two C-shaped rings 29), since the steel ball 33 in the operating hydraulic space 312 (a kind of one-way valve) of the guiding passage 311 of the piston 31 is pushed by the pressure of the hydraulic oil W to move to the close mouth 314 of the guiding passage 311, the close mouth 314 is sealed by the steel ball 33. In this case, the hydraulic oil W between the sliding bush 41 at a side of the inner wall 42 of the sliding cylinder 40 and the piston 31 will flow to the first guiding mouth 442 of the flow-adjusting screw 49B via the first outlet 441 and the first flow passage 44 of the sliding cylinder 40. Meanwhile, the hydraulic oil W also flows to the second guiding mouth 432 of the flow-adjusting screw 49A via the second outlet 431 and the second flow passage 43, and then flows into the hydraulic space between the sliding bush 45 and the piston 31. At the moment, due to the flow limit of the two flow-adjusting screws 49A, 49B, a predetermined buffering force is caused in a reverse direction when the door-closing spring 50 pushes the sliding cylinder 40 to close the door.

Figure 8:
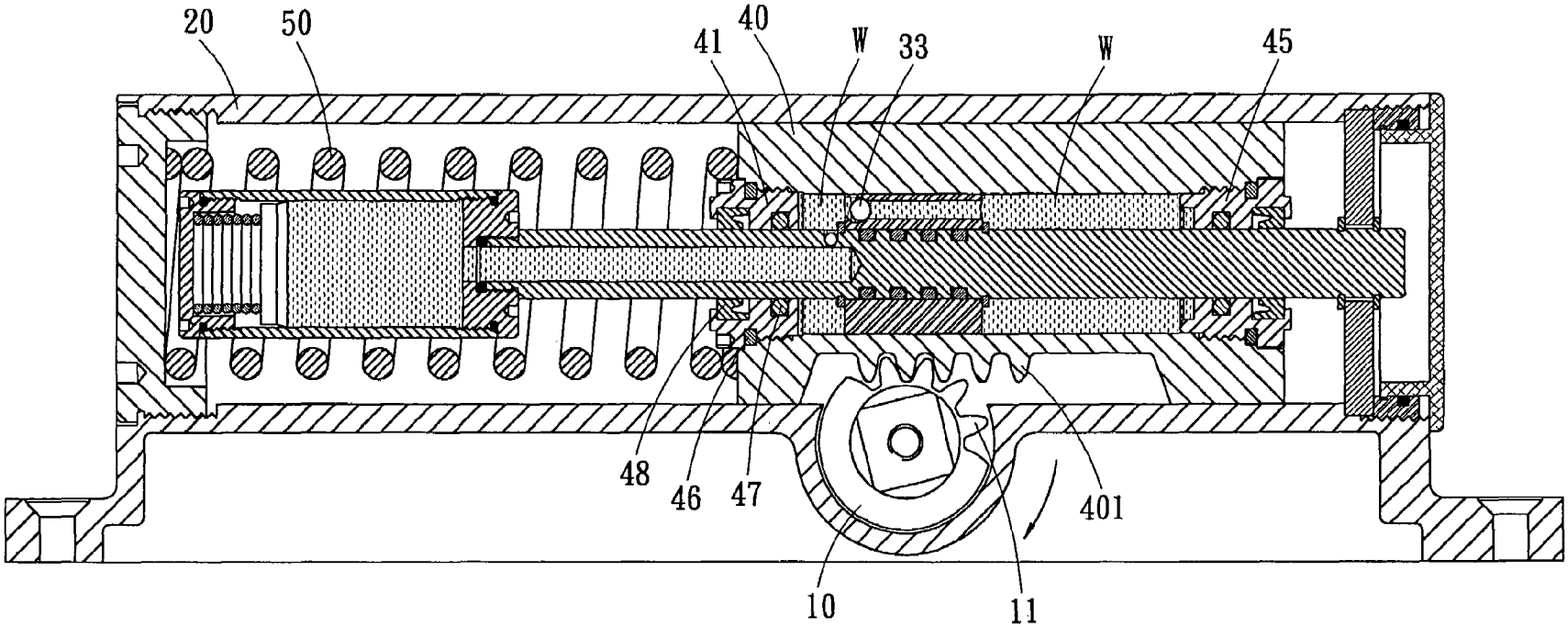
FIG. 8 is another operational view of a door closer in accordance with a first embodiment of the present invention, wherein the door is being closed.
Figure 9:
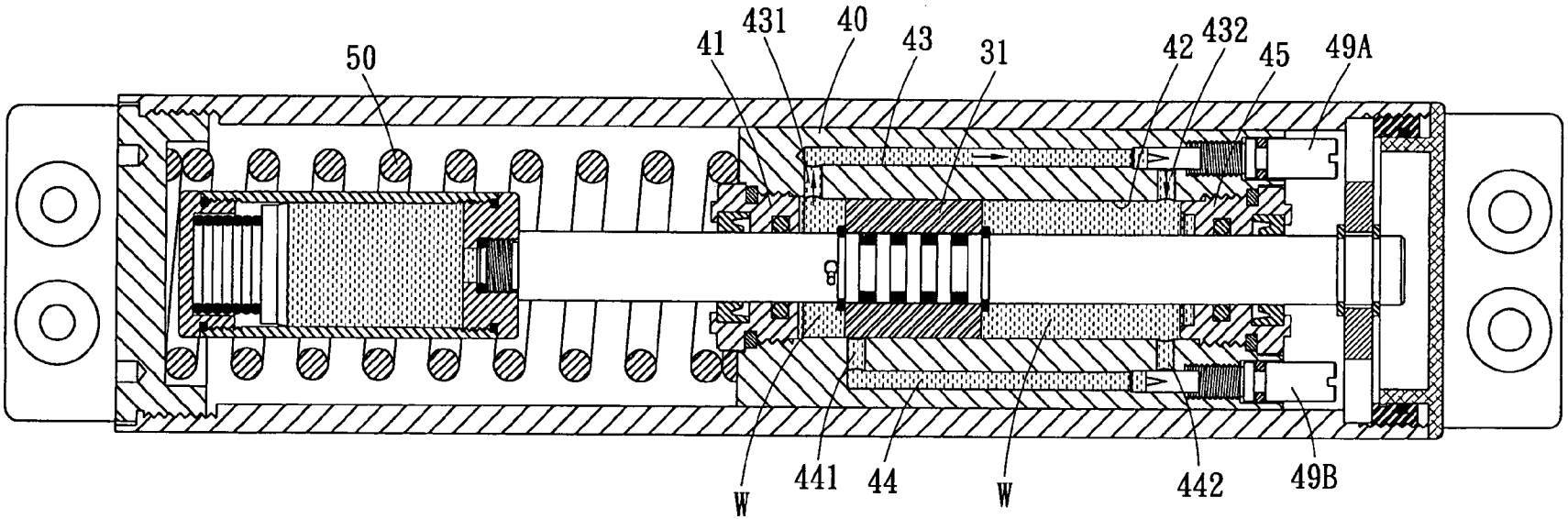
FIG. 9 is another operational view of a door closer in accordance with a first embodiment of the present invention, wherein the door is being closed.

With reference to FIGS. 8 and 9, when the user keeps closing the door and the action of the door-closing is near ending, the door-closing spring 50 keeps pushing the sliding cylinder 40 to move and the piston 31 blocks the first outlet 441 of the sliding cylinder 40, the hydraulic oil W in the sliding cylinder 40 has to flow to the hydraulic space at another side of the sliding cylinder 40 (the hydraulic space between the sliding bush 45 and the piston 31) only via the second outlet 431 of the second flow passage 43 and the second guiding mouth 432 on the flow-adjusting screw 49A. Since the hydraulic oil W flows to the hydraulic space at another side of the sliding cylinder 40 (the hydraulic space between the sliding bush 45 and the piston 31) only via the second guiding mouth 432 on the flow-adjusting screw 49A, the flow limit of the flow-adjusting screw 49A will produce a strong buffering force, such that the door-closing force will be buffered and become soft when the door-closing action is near ending, (at this moment, the buffering force can be arbitrarily adjusted by rotating the flow-adjusting screw 49C).

Figure 10:
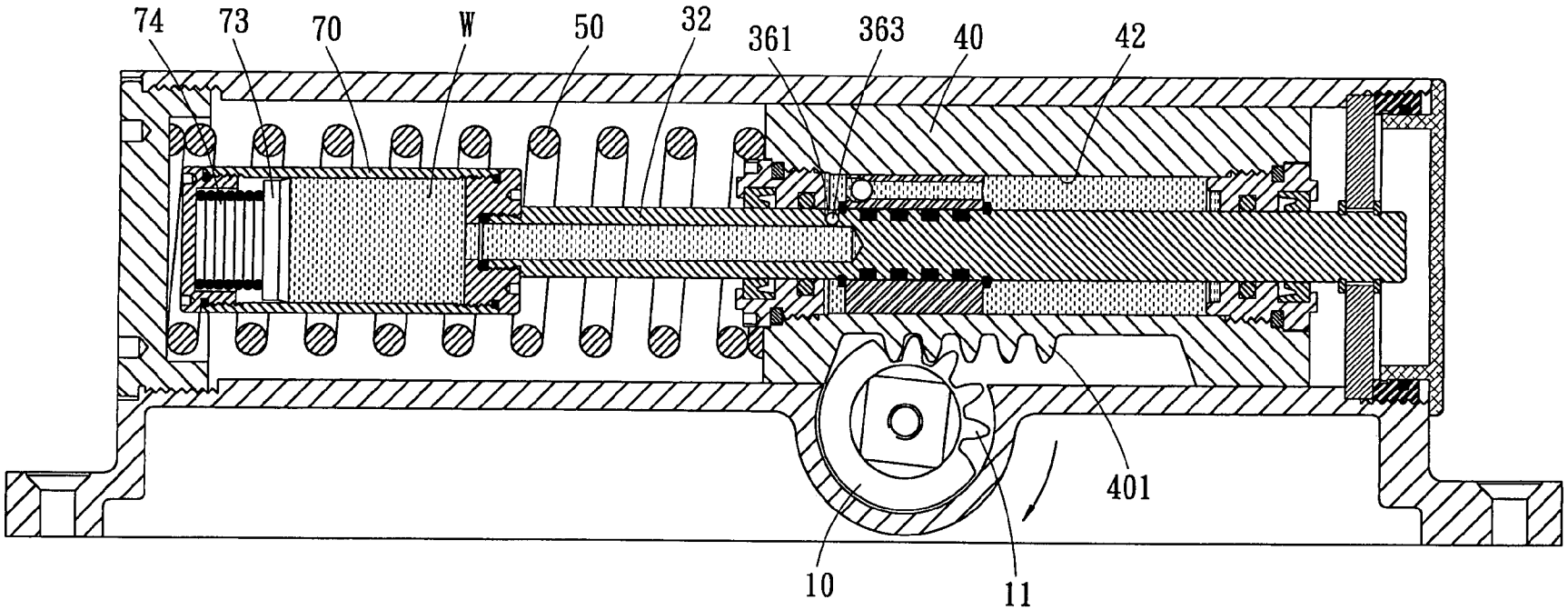
FIG. 10 is an operational view of a door closer in accordance with a first embodiment of the present invention, wherein the door is closed.

With reference to FIG. 10, the oil-pressure piece 73 in the oil-replenishing cylinder 70 will be pushed by the spring 74 and produces a predetermined oil pressure. When the hydraulic oil in the sliding cylinder 40 is reduced due to evaporation, the oil-pressure piece 73 will push the hydraulic oil W in the oil-replenishing cylinder 70 to the outlet 361 of the shaft 32, and the hydraulic oil W will further push a clack 363 of the one-way valve 362 and make it open (the outlet 361 is open), so as to enable the hydraulic oil W in the oil-replenishing cylinder 70 to flow to the inner wall 42 of the sliding cylinder 40 via the outlet 361. When the door closer is being applied and the oil pressure in the inner wall 42 of the sliding cylinder 40 is greater than that of the replenished hydraulic oil, the one-way valve 362 will be closed, the oil pressure in the inner wall 42 makes the clack 363 move close to the close end (the outlet 361 is closed). Thereby, the hydraulic oil will be constantly replenished into the piston shaft by the oil-replenishing cylinder, such that the lifetime of the working part of the door closer in accordance with the present invention for producing buffering effect is effectively prolonged.

Figure 11:
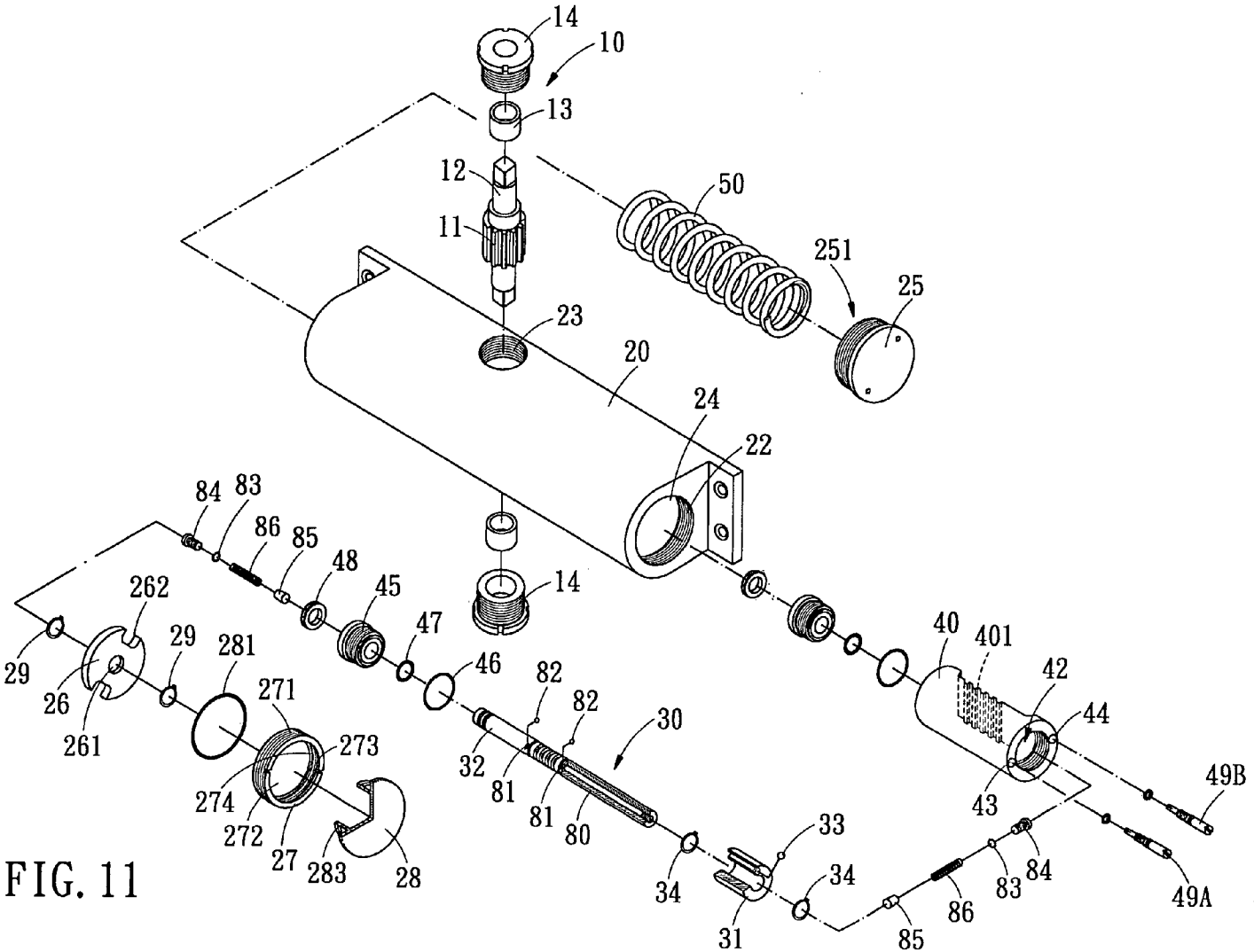
FIG. 11 is an exploded view of a door closer in accordance with a second embodiment of the present invention.
Figure 12:
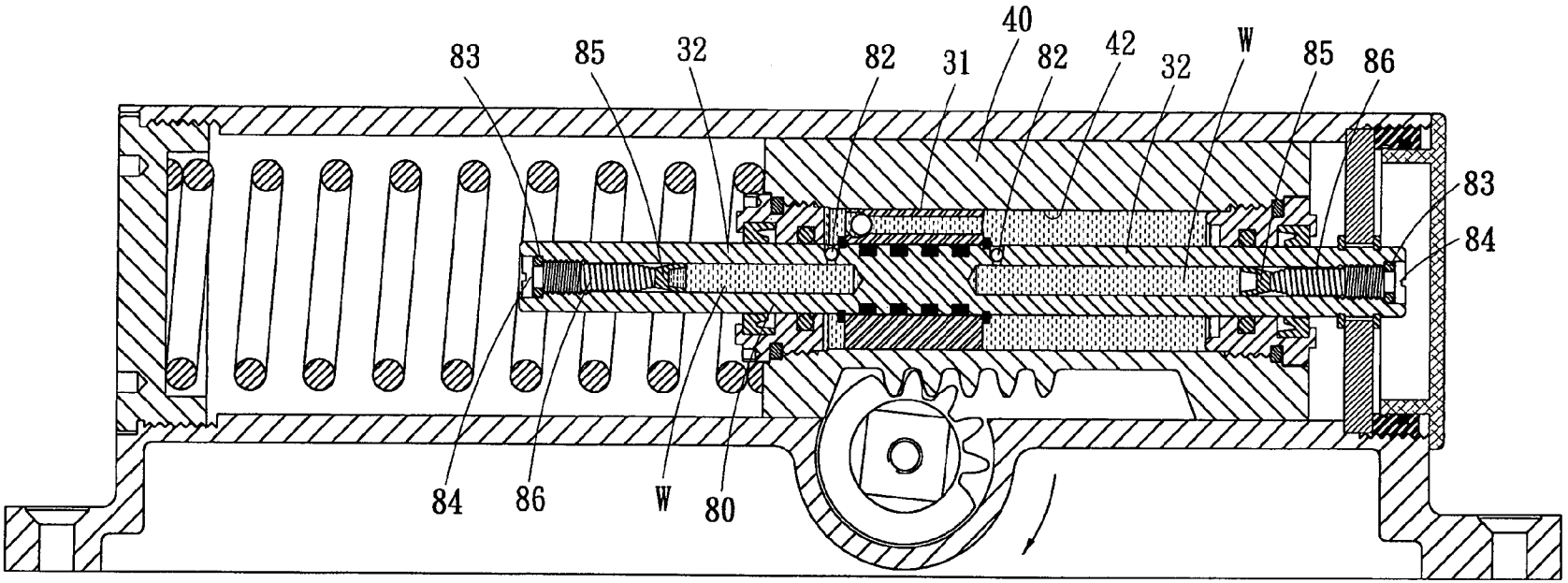
FIG. 12 is a cross sectional view of a door closer in accordance with a second embodiment of the present invention.

On the other hand, with reference to a second embodiment in accordance with the present invention which is shown in FIGS. 11 and 12, wherein the shaft 32 of the piston shaft 30 is formed at both ends thereof with oil replenishing passages 80, an one-way valve 81 having clack 82 is defined in the oil replenishing passages 80 respectively and located close to the piston 31. Both of the oil replenishing passages 80 are provided with a spring cover 84 that serve to seal an outer seal ring 83, a spring 86 and an oil-pressure piece 85 in the oil replenishing passages 80. The oil replenishing passages 80 are filled with hydraulic oil W, and the oil-pressure piece 85, by taking advantage of the elastic force of the spring 86, is employed to push the hydraulic oil to the inner wall 42 of the sliding cylinder 40 via the one-way valve 81. Besides the oil-replenishing system in the first embodiment of the present invention, the second embodiment in accordance with the present invention provides another kind of door closer filled with lesser hydraulic oil W that is particularly used in the frigid zone where the evaporation is low. And the hydraulic oil W also can be automatically replenished to the door closer in accordance with the second embodiment of the present invention.

Figure 13:
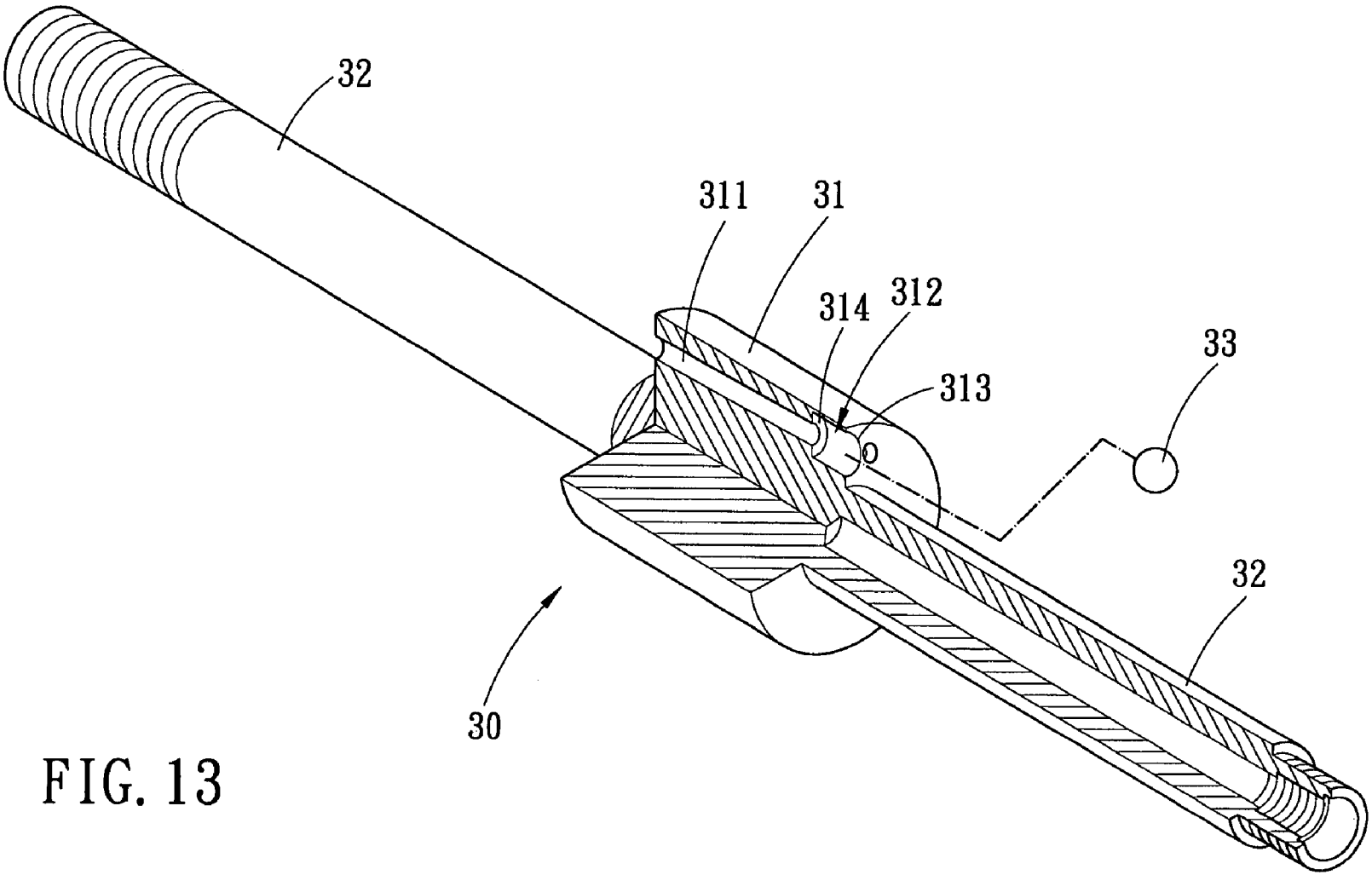
FIG. 13 is a partial perspective view of a door closer in accordance with a third embodiment of the present invention.

Referring further to FIG. 13, which shows a piston shaft 30 in accordance with a third embodiment of the present invention, wherein the shaft 32 and the piston 31 can be integrally formed.

Figure 14A:
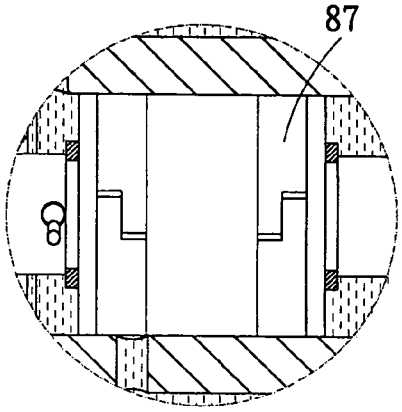
FIG. 14*a* is a partial cross sectional view of a door closer in accordance with a fourth embodiment of the present invention.
Figure 14B:
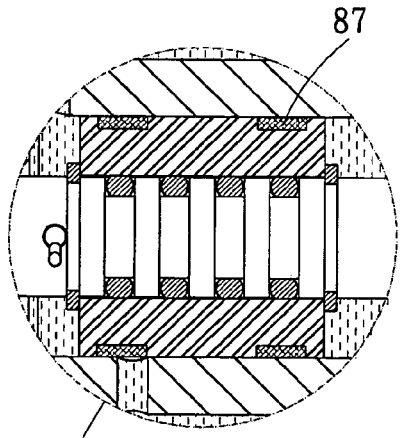
FIG. 14*b* is another partial cross sectional view of a door closer in accordance with a fourth embodiment of the present invention.
Figure 14C:
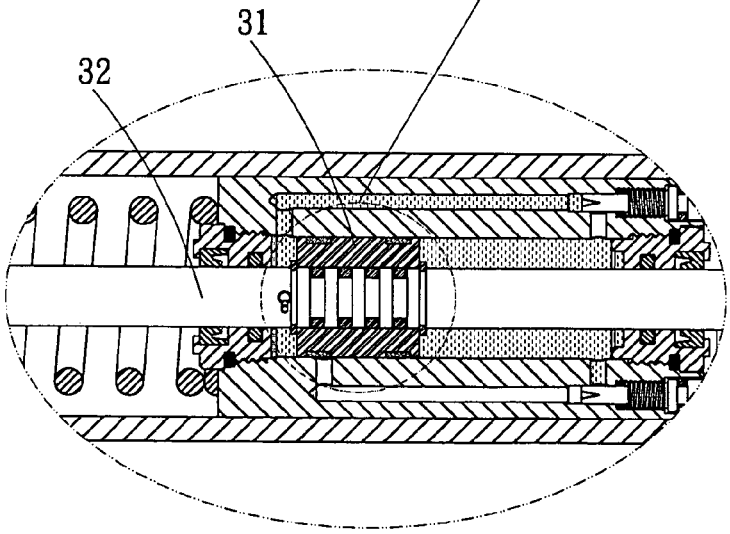
FIG. 14*c* is another partial cross sectional view of a door closer in accordance with a fourth embodiment of the present invention.
Figure 15:
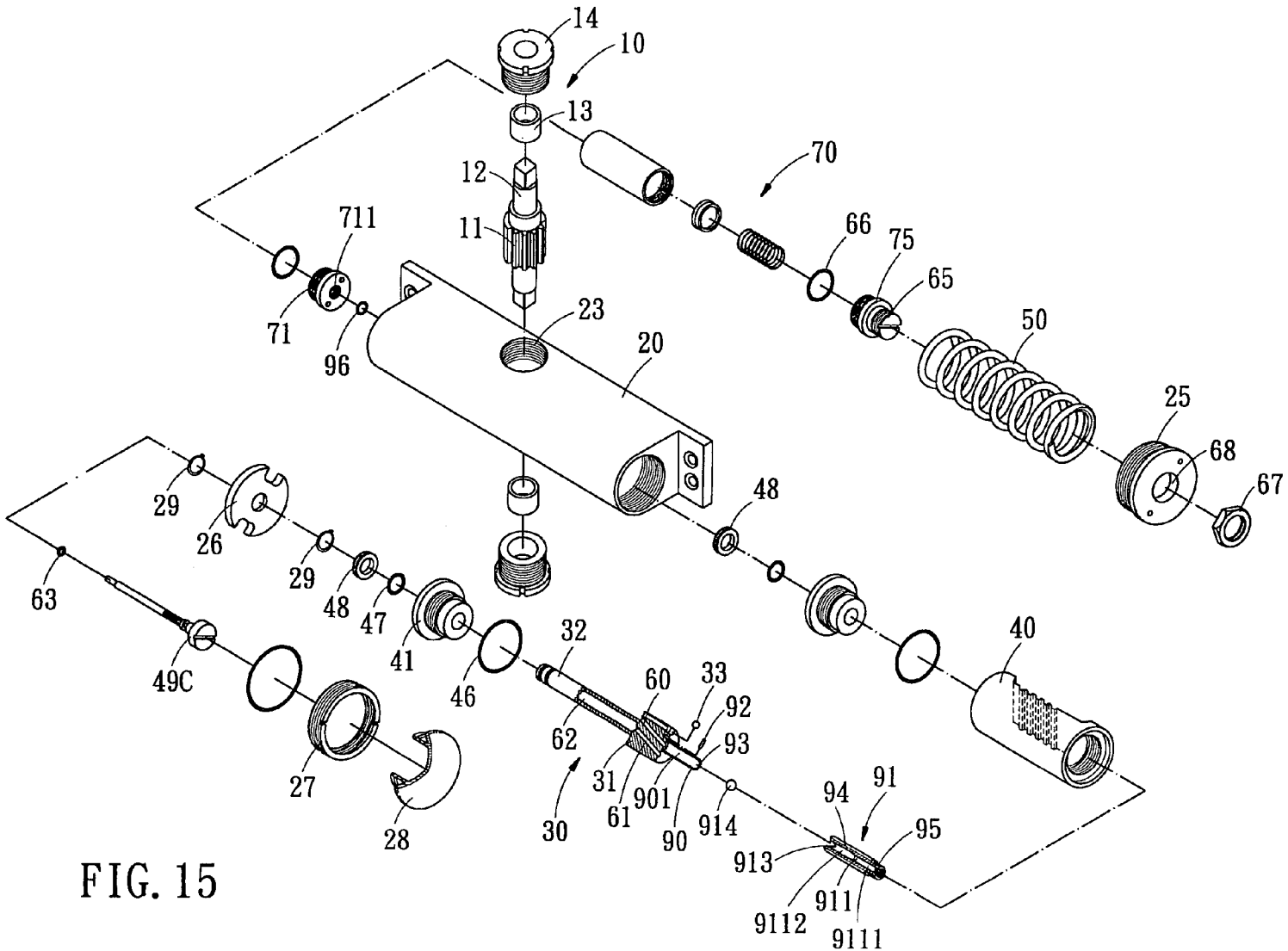
FIG. 15 is an exploded view of a door closer in accordance with a fifth embodiment of the present invention.

Referring to FIGS. 14*a*, 14*b* and 14*c*, which show a fourth embodiment in accordance with the present invention, the piston 31 of the piston shaft 30 can be provided on an outer periphery thereof with wearable ring 87, both ends at junction of the wearable ring 87 are step-configured and connected to each other in a stepped manner, so as to prevent leakage of the hydraulic oil W from this junction.

Referring to FIGS. 15–21, which show a fifth embodiment of the present invention, the two flow passages 43, 44 can be replaced by a first axial passage 60 and a second axial passage 61 respectively formed in the piston 31 of the piston shaft 30. The shaft 32 of the piston shaft 30 is slidably disposed on the leak-proof assembly G of the sliding cylinder 40.

The shaft 32 at a first end of the piston 31 is interiorly provided with a hollow pipe 62 for insertion of a flow-adjusting screw 49C. The pipe 62 is connected to the second axial passage 61, and an end of the flow-adjusting screw 49C is provided with an oil seal 63, the user can adjust the flow-adjusting screw 49C after opening the dust cover 28. Moreover, the spring cover 75 of the oil replenishing cylinder 70 of the housing 20 is provided at an rear end thereof with an adjusting bolt 65, which is inserted in an adjusting hole 68 at the center of the spring cover 25 by cooperating with a dust ring 66 and a screw nut 67.

Figure 16:
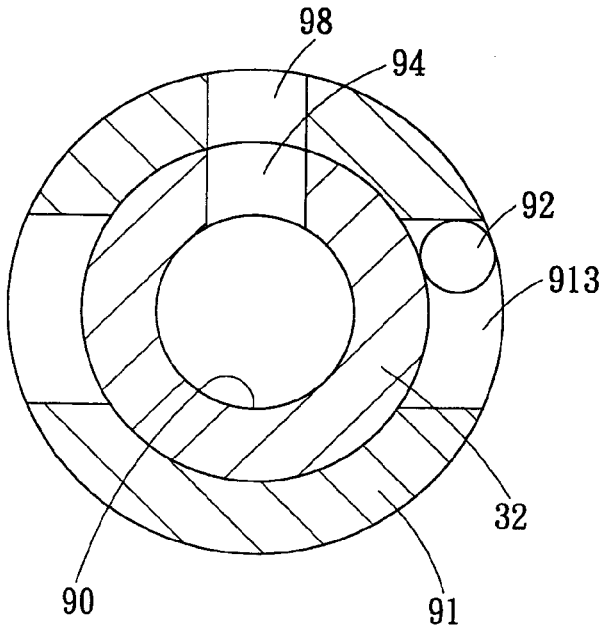
FIG. 16 is a partial cross sectional view of a door closer in accordance with a fifth embodiment of the present invention.
Figure 17:
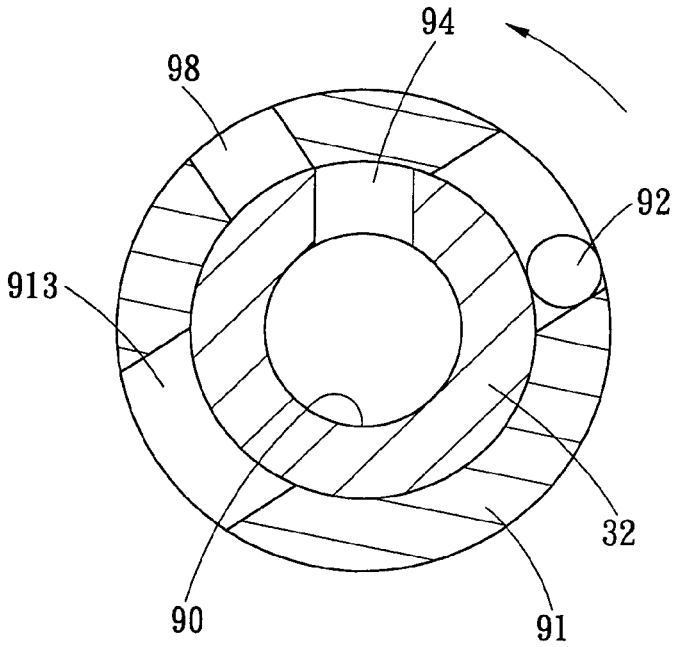
FIG. 17 is another partial cross sectional view of a door closer in accordance with a fifth embodiment of the present invention.

The shaft 32 at a second end of the piston 31 is interiorly formed with a hollow pipe 90, both ends of which are connected to the first axial passage 60 and an adjusting pipe 91 respectively. A groove 93 is defined at the end of the shaft 32, and the shaft 32 inserts in a big central hole 9112 of the adjusting pipe 91. A guiding hole 94 is formed between the inner periphery and the outer periphery of the shaft 32 and located a distance N away from the end of the piston 31. The piston 31 is provided at the surface of the second end with a positioning pin 92 which serves to adjust the flow rate of the hydraulic oil by cooperating with a locating slot 913 defined at the end of the adjusting pipe 91. The adjusting pipe 91 is interiorly formed with a two-step central hole 911, the big central hole 9112 serves to receive the shaft 32 of the piston 31. A guiding hole 98 is transversely formed on sidewall of the big central hole 9112 and located at a position corresponding to the shaft 32 of the piston 31, and the locating slot 913 is formed at the end of the big central hole 9112. The locating slot 913 and the positioning pin 92 of the piston 31 are positioned to each other, such that a common mouth between the guiding hole 98 and that guiding hole 94 on the shaft 32 of the piston 31 can be adjusted, and the flow of the hydraulic oil can be adjusted accordingly. In addition, a one-way valve 97 is defined at an end of the adjusting pipe 91 corresponding to a small central hole 9111. The one-way valve 97 will be closed when a clack 914 of which is moved to the small central hole 911 (to prevent hydraulic oil W flowing to the oil replenishing cylinder via the inner wall), and it will be opened when the clack 914 moves close to the groove 93 of the shaft 32 (the inner wall is shortage of hydraulic oil, it can be replenished via the oil replenishing cylinder). An end of the adjusting pipe 91 is disposed in the leak-proof assembly F of the sliding cylinder 40. By cooperating with the inner seal ring 47 and the oil-sealing member 48 of the sliding bush, the sliding cylinder 40 can slide on the adjusting pipe 91 in a hermetic manner. Another end of the adjusting pipe 91 is defined with threads 95 which are screwed in the threaded hole 711 of the oil replenishing cylinder 70 by cooperating with a seal ring 96. The adjusting bolt is integrally formed at the rear end of the spring cover 75 of the oil replenishing cylinder 70. In this case, the adjusting pipe 91 will be driven to rotate when rotating the adjusting screw 65, such that the common mouth between the guiding hole 98 and that guiding hole 94 on the shaft 32 of the piston 31 can be adjusted. When the guiding holes 94, 98 are aligned with each other (the common mouth is adjusted to the widest) the flow reaches the maximum velocity (as shown in FIG. 16). The flow will be reduced when the guiding holes 94, 98 are misaligned to each other (as shown in FIG. 17).

Therefore, in the fifth embodiment of the present invention, the adjusting screw 65 can be used to adjust the flow of hydraulic oil in the first axial passage 60 and the adjusting screw 49C is able to adjust the flow of hydraulic oil in the second axial passage 61. As a result, the user is able to adjust the buffering force of the door closer to a desired extent.

Referring further to FIGS. 18–21, which show the operating principle of the door closer in accordance with the fifth embodiment of the present invention.

Figure 18:
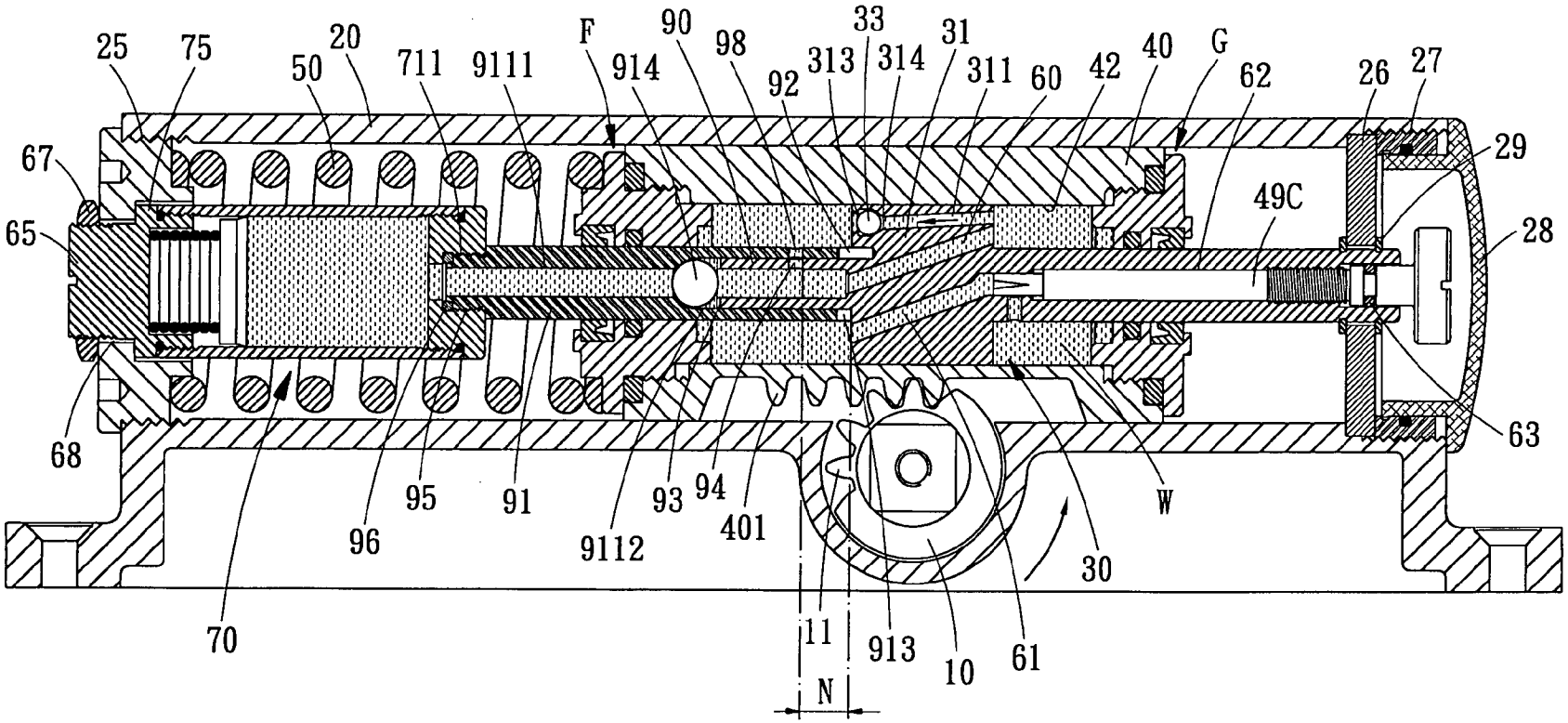
FIG. 18 is a cross sectional view of door closer in accordance with the fifth embodiment of the present invention, wherein the door is being opened.

As shown in FIG. 18, when the user opens the door by force, the panel of the door drives the gear wheel 11 of the door shaft 10 to rotate, and the gear wheel 11 will move the sliding cylinder 40 toward the door-closing spring 50 by driving the teeth 401. In this case, the door-closing spring 50 is compressed by the cylinder 40, meanwhile, since the inner wall 42 in the sliding cylinder 40 and the piston 31 of the piston shaft 30 move relative to each other, and the piston shaft 30 is fixed to the positioning member 26 by virtue of two C-shaped ring 29, and the positioning member 26 is fixed to an end of the housing by the fixing ring 27. Thereby, the sliding cylinder 40 will be driven to move by the gear wheel 11 of the door shaft 10, at the moment, the hydraulic oil in the hydraulic space at a side of the inner wall 42 of the sliding cylinder 40 (between the leak-proof assembly G and the piston 31) is compressed and pushes the steel ball 33 in the one-way valve of the piston 31 to move toward the open mouth 313, so as to the open the guiding passage 311 of the piston 31. Thus, via the open mouth 313, the hydraulic oil W in the hydraulic space of the sliding cylinder 40 (between the leak-proof assembly G and the piston 31) will flow to the hydraulic space between the leak-proof assembly F and the piston 31. At the same time, the small central hole 9111 in the adjusting pipe 91 and the clack 914 serve to prevent the hydraulic oil flowing from the inner wall 42 to the oil replenishing cylinder 70, and the hydraulic oil flow to the hydraulic space between the leak-proof assembly F of the sliding cylinder 40 and the piston 30 only, so as to make the hydraulic oil flow smoothly. Thereby, when the door closer is applied to open the door, the buffering force of the hydraulic oil is so small that the user can open the door by a small force equal to the compressive force of the door-closing spring 50.

Figure 19:
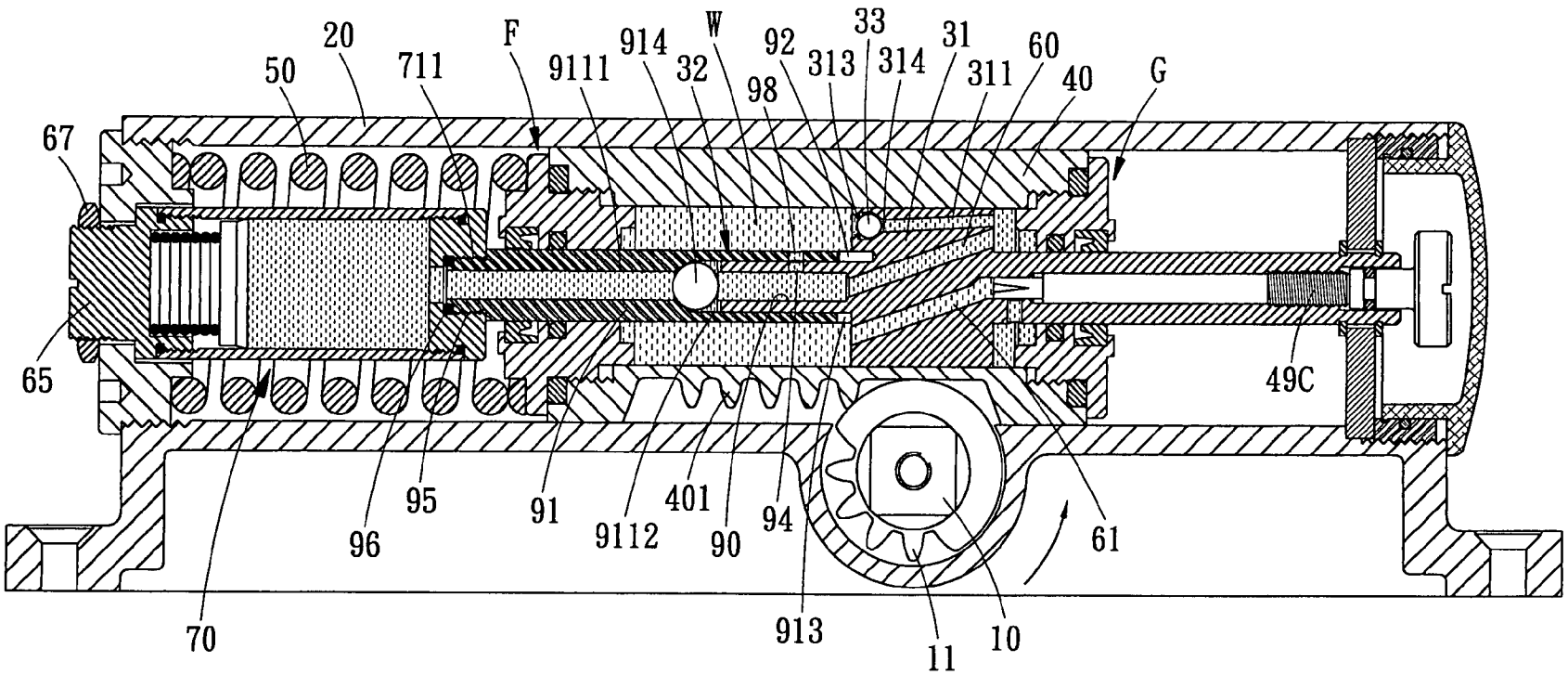
FIG. 19 is a cross sectional view of door closer in accordance with the fifth embodiment of the present invention, wherein the door is positioned.

As shown in FIG. 19, when the door is opened to a predetermined angle, the gear wheel 11 of the door shaft 10 will idly rotate relative to the teeth 401 of the sliding cylinder 40, at this moment, if the door is opened more wide, the gear wheel 11 of the door shaft 10 still idly rotates relative to the teeth 401, and it will not push the sliding cylinder 40 to move, and thus the door-closing spring 50 will not be compressed.

Figure 20:
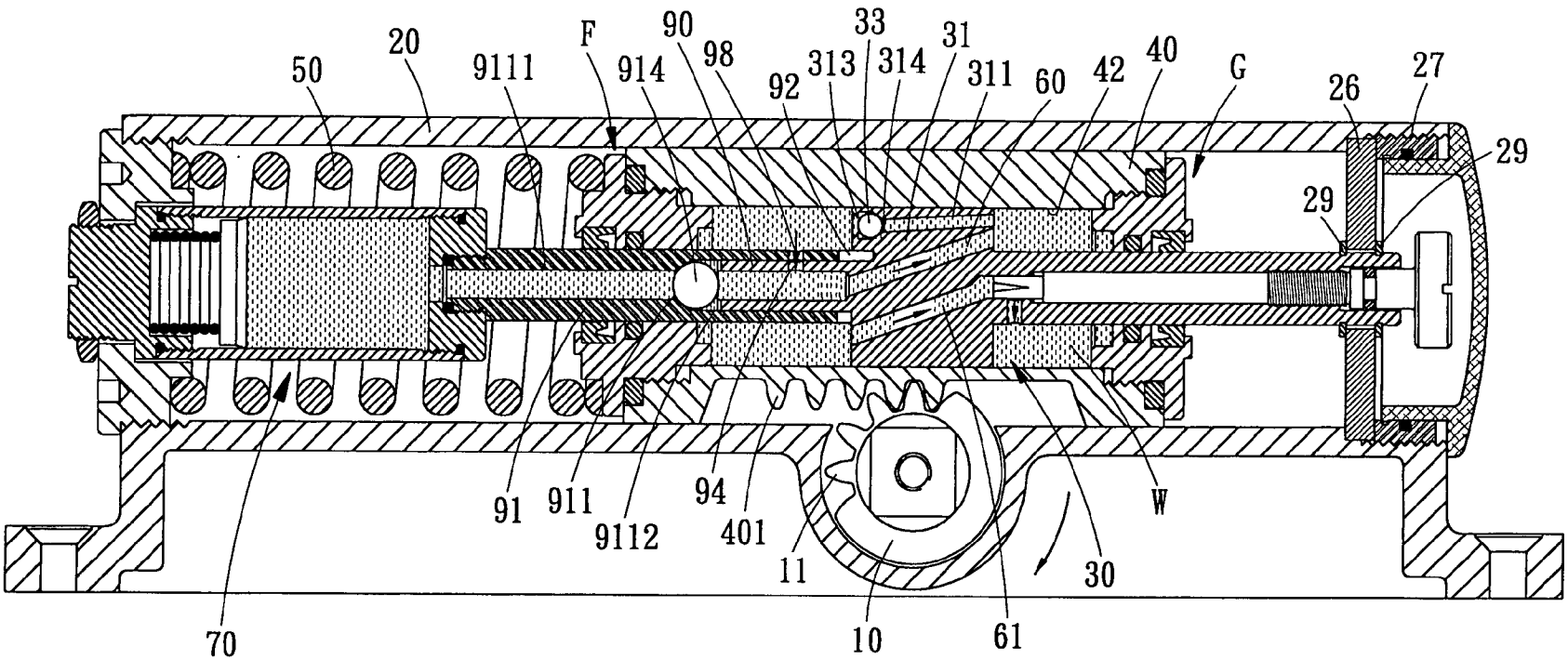
FIG. 20 is a cross sectional view of door closer in accordance with the fifth embodiment of the present invention, wherein the door is being closed.

As shown in FIG. 20, when the user closes the door, the door-closing spring 50 expands to push the sliding cylinder 40 to move toward the leak-proof assembly G, and the gear wheel 11 of the door shaft 10 is driven by the teeth 401 of the sliding cylinder 40 to rotate clockwise, and the panel of the door is driven to rotate, thus the door is closed. At this moment, the inner wall 42 in the sliding cylinder 40 moves relative to the piston 31 of the piston shaft 30, and the piston shaft 30 is fixed to the positioning member 26 of the housing by two C-shaped rings 29, and the positioning member 26 is fixed to an end of the housing by the fixing ring 27. Thereby, when the sliding cylinder 40 is pushed to move by the door closing spring 50, the hydraulic oil in the hydraulic space at a side of the inner wall 42 of the sliding cylinder 40 (between the leak-proof assembly F and the piston 31) is compressed and pushes the steel ball 33 in the one-way valve of the piston 31 to move toward the close mouth 314, so as to the close the guiding passage 311 of the piston 31. As a result, the hydraulic oil W in the hydraulic space at the side of the inner wall 42 (between the leak-proof assembly F and the piston 31) will flow to the guiding hole 98 of the adjusting pipe 91 via the piston shaft 30, the shaft 32, the guiding hole 94, the hollow pipe 90 and the first axial passage 60. Meanwhile, via the second axial passage 61 and under the flow-control of the adjusting screw 49C, the hydraulic oil W will flow to the hydraulic space between the leak-proof assembly G and the piston 31. Through this way, a predetermined buffering force will be generated when the door-closing spring 50 pushes the sliding cylinder 40 to close the door (the buffering force can be adjusted by rotating the adjusting screw 65 to adjust the common mouth between the guiding hole 98 of the adjusting pipe 91 and the guiding hole 94 of the shaft 32).

Figure 21:
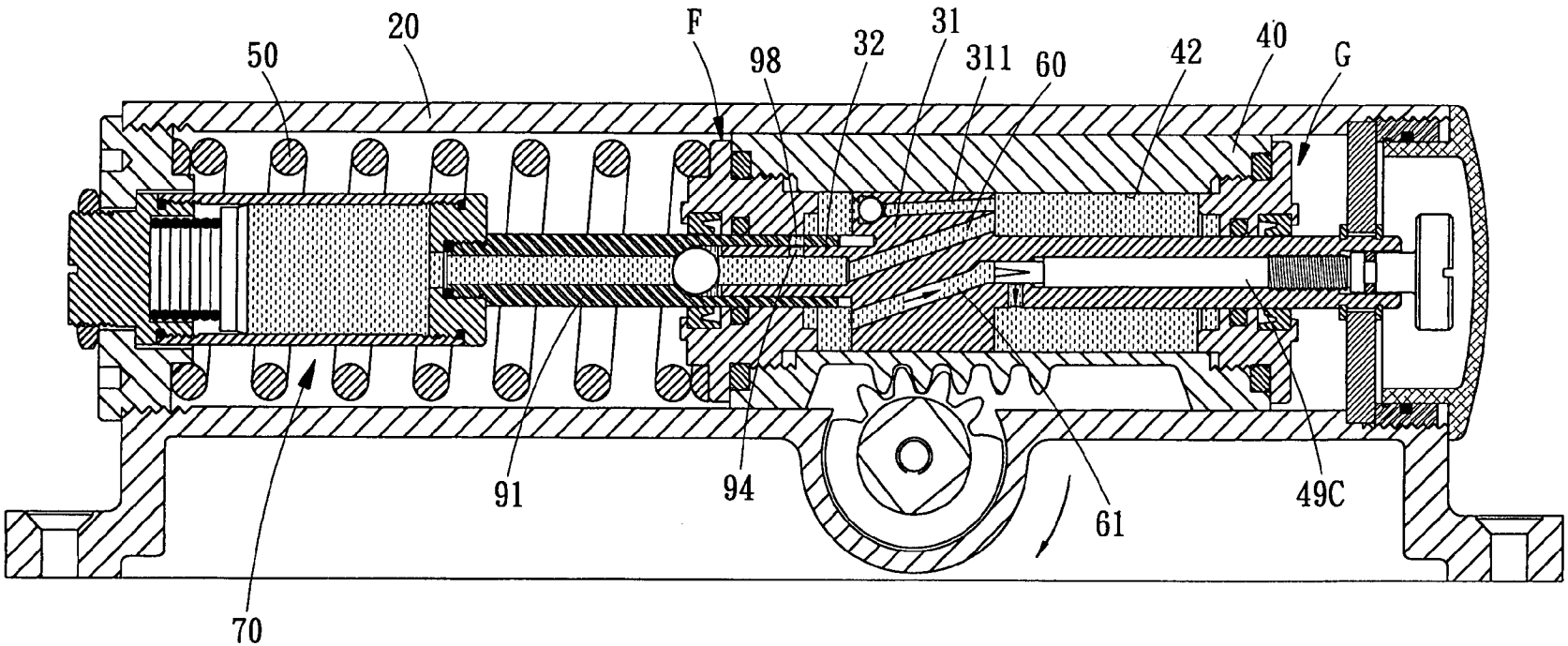
FIG. 21 is a cross sectional view of door closer in accordance with the fifth embodiment of the present invention, wherein the door is being opened.

Referring to FIG. 21, when the user keeps closing the door and the action of the door-closing is near ending, the door-closing spring 50 keeps pushing the sliding cylinder 40 to move. When the first axial passage 60 of the piston shaft 30 (the guiding holes 94, 98 of the adjusting pipe 91 and of the shaft 32) are blocked by the leak-proof assembly F at a side of the sliding cylinder 40, the hydraulic oil W in the sliding cylinder 40 has to flow to the hydraulic space at another side of the sliding cylinder 40 (the hydraulic space between the leak-proof assembly G and the piston 31) only via the second axial passage 61 of the piston shaft 30 and the flow-adjusting screw 49C. The flow limit of the flow-adjusting screw 49C will produce a strong buffering force (the first axial passage 60 is blocked), such that the door-closing force will be buffered and become soft when the door-closing action is near ending, and the flow limit will be in effect until the door-closing action is ended (at this moment, the buffering force can be arbitrarily adjusted by rotating the flow-adjusting screw 49C).

While we have shown and described various embodiments in accordance with the present invention, it should be clear to those skilled in the art that further embodiment may be made without departing from the scope of the present invention.

What is claimed is:

1. A door closer, comprising a door shaft, a housing, a piston shaft, a sliding cylinder and a door-closing spring, the sliding cylinder slidably disposed in the housing of the door closer in a manner that the sliding cylinder meshed with the door shaft, the door-closing spring located between the housing and the sliding cylinder, wherein:

the sliding cylinder, an outer periphery of which is formed with teeth for meshing with a plurality of teeth formed on the door shaft, the piston shaft includes a shaft and a piston, the piston is moveably mounted on the shaft in such a manner that an outer surface of the shaft closely abuts against an inner surface of the piston, and the piston is slidably received in the sliding cylinder in such a manner that the outer surface of the piston shaft closely abuts against an inner wall of the sliding cylinder both ends of the piston shaft are inserted in an leak-proof assembly at both ends of the sliding cylinder, inside of the piston shaft is formed an outlet in which being received an one-way valve, the piston is interiorly formed with a guiding passage in which is formed an operating hydraulic space containing a steel ball for the one-way valve, hydraulic oil in the sliding cylinder flows between the inner wall of the sliding cylinder and the piston shaft via the one-way valve, the piston of the piston shaft is further formed with an axial passage which is connected between the operating hydraulic spaces at both ends of the piston, in the axial passage is provided with flow-adjusting screw.

2. The door closer as claimed in claim 1, wherein the shaft is a hollow pipe and connected to an adjusting pipe, the shaft is formed with guiding hole, an end of the adjusting pipe is a hollow pipe which is formed with guiding hole, a radial position of the guiding hole in the adjusting pipe corresponds to the guiding hole of the shaft of the piston shaft, flow of the axial passage can be adjusted by relative rotation between the shaft of the piston shaft and the adjusting pipe, and the axial passage is connected to the hydraulic space at both ends of the piston.

3. The door closer as claimed in claim 1, wherein the piston shaft is provided with an oil replenishing cylinder, the oil replenishing passage connected to hydraulic space of the sliding cylinder is formed inside of the shaft of the piston shaft, in an outlet of the oil replenishing passage is sealed an one-way valve, an oil-pressure piece and a spring are respectively sealed in the oil replenishing cylinder in a manner that the spring abuts against a side of the oil-pressure piece and a space at another side of the oil-pressure piece is filled with hydraulic oil, the oil-pressure piece serves to push the hydraulic oil toward the oil replenishing passage of the shaft of the piston shaft.

4. The door closer as claimed in claim 3, wherein the shaft of the piston shaft is a hollow structure that can be used as an oil replenishing cylinder, in which is formed the oil replenishing passage that is connected to the hydraulic space of the sliding cylinder, and an oil-pressure piece and a spring are disposed in inner wall of the piston shaft, the oil-pressure serves to push the hydraulic oil to flow toward the oil replenishing passage of the shaft.

5. The door closer as claimed in claim 4, wherein the inner wall of the shaft at both ends of the piston shaft are interiorly provided with oil replenishing cylinder.

6. The door closer as claimed in claim 3, wherein the shaft at an end of the piston shaft is formed in the inner wall thereof with the oil replenishing cylinder and the shaft at another end of the piston shaft is provided with an independent oil replenishing cylinder.

7. A door closer comprising a door shaft, a housing, a sliding cylinder, a piston shaft, an oil replenishing cylinder and a door-closing spring, the sliding cylinder slidably disposed in the housing of the door closer, an outer periphery of the sliding cylinder formed with teeth for meshing with a gear wheel of the door shaft, the piston shaft includes a shaft and a piston, and the piston is slidably received in the sliding cylinder in such a manner that the outer periphery of the piston shaft closely abuts against an inner wall of the sliding cylinder, on the piston shaft is mounted an oil replenishing cylinder, a shaft of the piston shaft is interiorly formed with an oil replenishing passage which is connected to hydraulic space of the sliding cylinder.

8. The door closer as claimed in claim 7, wherein the piston shaft is provided with the oil replenishing cylinder, the shaft of piston shaft is hollow and connected to the hydraulic space, an oil-pressure piece and an spring are respectively sealed in the oil replenishing cylinder in a manner that the spring abuts against a side of the oil-pressure piece and a space at another side of the oil-pressure piece is filled with hydraulic oil, the oil-pressure piece serves to push the hydraulic oil toward the oil replenishing passage of the shaft of the piston shaft, in the shaft of the piston shaft is formed with a small central hole, in which is received a clack which cooperates with the small central hole to prevent reverse flow of the hydraulic oil.

* * * * *